US012287183B2

(12) United States Patent
Bezuidenhout et al.

(10) Patent No.: US 12,287,183 B2
(45) Date of Patent: Apr. 29, 2025

(54) EXPLOSIVE BOOSTER

(71) Applicant: AECI MINING LIMITED, Sandton (ZA)

(72) Inventors: Hendrik Cornelius Bezuidenhout, Centurion (ZA); Tondani Carol Tshikosi, Johannesburg (ZA); Phillippus Rudolph Van Den Berg, Vanderbijlpark (ZA)

(73) Assignee: AECI Mining Limited, Sandton (ZA)

( * ) Notice: Subject to any disclaimer, the term of this patent is extended or adjusted under 35 U.S.C. 154(b) by 0 days.

(21) Appl. No.: 18/456,882

(22) Filed: Aug. 28, 2023

(65) Prior Publication Data

US 2025/0076009 A1 Mar. 6, 2025

(51) Int. Cl.
*F42B 3/26* (2006.01)
*F42B 1/02* (2006.01)

(52) U.S. Cl.
CPC . *F42B 3/26* (2013.01); *F42B 1/02* (2013.01)

(58) Field of Classification Search
CPC ..... F42B 3/26; F42B 1/02; F42B 3/00; F42B 3/08; F42B 3/24; F42B 3/02; E21B 43/1185
See application file for complete search history.

(56) References Cited

U.S. PATENT DOCUMENTS 3,431,851 A * 3/1969 Kern ..... F42B 3/26 102/318
3,604,353 A * 9/1971 Newman ..... F42B 1/04 102/332
4,015,526 A * 4/1977 Bond ..... F42B 3/02 181/118
4,037,536 A * 7/1977 Griffith ..... F42B 39/20 102/331
4,141,296 A * 2/1979 Calder, Jr. ..... F42D 1/10 102/318
4,178,852 A * 12/1979 Smith ..... F42B 3/26 102/275.9
4,295,424 A * 10/1981 Smith ..... F42B 3/00 102/331

(Continued)

OTHER PUBLICATIONS

Technical Data Sheet, Pentex® G L, dated Jun. 23, 2017, Orica.com, 2 pages.

(Continued)

*Primary Examiner* — Joshua E Freeman
(74) *Attorney, Agent, or Firm* — Stinson LLP

(57) ABSTRACT

An explosive booster for initiating, and thus causing detonation of, a bulk explosive, includes a hollow body comprising a base member and a sidewall projecting from the base member. The body defines an interior space between the base member and the sidewall for containing a detonable booster formulation in use. A hollow elongate initiator locating formation projects longitudinally into the interior space at least from the base member and defines an initiator channel that is open through the base member, for locating an explosive initiator in initiating proximity relative to a detonable booster formulation contained in the interior space in use. The initiator channel extends longitudinally along a central longitudinal axis thereof that is radially spaced from, and parallel to, a central longitudinal axis along which the interior space longitudinally extends.

17 Claims, 8 Drawing Sheets

(56) References Cited

U.S. PATENT DOCUMENTS

| | | | | | |
|---|---|---|---|---|---|
| 4,334,476 | A * | 6/1982 | Day | F42B 3/26 | 102/466 |
| 4,383,484 | A * | 5/1983 | Morrey | F42B 3/26 | 102/275.12 |
| 4,425,849 | A * | 1/1984 | Jorgenson | F42D 1/045 | 102/275.12 |
| 4,485,741 | A * | 12/1984 | Moore | F42B 3/26 | 102/317 |
| 4,637,312 | A * | 1/1987 | Adams | F42B 3/26 | 102/275.12 |
| 4,765,246 | A * | 8/1988 | Carlsson | F42D 1/04 | 102/275.12 |
| 4,776,276 | A * | 10/1988 | Yunan | C06B 45/00 | 102/275.12 |
| 4,796,533 | A * | 1/1989 | Yunan | F42D 1/04 | 102/275.12 |
| 4,799,428 | A * | 1/1989 | Yunan | C06C 7/00 | 102/275.12 |
| 5,614,693 | A * | 3/1997 | Welch | F42B 3/10 | 102/318 |
| 5,763,816 | A * | 6/1998 | Keeling | C06C 7/00 | 102/275.12 |
| 6,112,666 | A * | 9/2000 | Murray | F42D 1/043 | 102/275.12 |
| 7,823,508 | B2 * | 11/2010 | Anderson | F42B 3/26 | 102/275.12 |
| 8,127,682 | B1 * | 3/2012 | Sonday | F42D 1/043 | 102/332 |
| 9,115,963 | B2 * | 8/2015 | Most | B29C 45/14 | |
| 9,285,199 | B2 * | 3/2016 | Beikoff | F42D 3/04 | |
| 11,209,250 | B2 * | 12/2021 | Zuriaga | F42D 1/043 | |
| 11,441,882 | B1 * | 9/2022 | Albrecht | F42C 19/0815 | |
| 2011/0036259 | A1 * | 2/2011 | Bengtsson | F42D 1/05 | 102/332 |
| 2012/0192748 | A1 * | 8/2012 | Scheid | F42B 3/26 | 403/221 |
| 2014/0345486 | A1 * | 11/2014 | Most | F42D 1/04 | 102/314 |
| 2015/0053105 | A1 * | 2/2015 | Beikoff | F42B 3/00 | 102/318 |
| 2019/0170487 | A1 * | 6/2019 | López Peirano | F42B 3/00 | |
| 2021/0404778 | A1 * | 12/2021 | Michna | F42B 3/28 | |
| 2024/0247557 | A1 * | 7/2024 | Drury | E21B 23/0414 | |

OTHER PUBLICATIONS

Product Information Sheet, Pentex® D, Copyright 2015, downloaded Nov. 10, 2022, Orica.com.

Technical Data Sheet, Pentex® 250-1700, dated Apr. 30, 2018, Orica.com, 3 pages.

Technical Data Sheet, Pentex® H Booster, dated Jan. 20, 2007, Orica.com, 2 pages.

Technical Data Sheet, Pentex® G Booster, dated Oct. 30, 2020, Orica.com, 2 pages.

Technical Data Sheet, Pentex® PowerPlus® P (PPP) Booster, dated Feb. 25, 2008, Orica.com, 2 pages.

Technical Data Sheet, Pentex® PowerPlus® 900 (PP900) Booster, dated Jan. 27, 2022, Orica.com, 2 pages.

Technical Data Sheet, Anzomax Power Plus Boosters, Material Not Dated, downloaded Nov. 10, 2022, www.oricaminingservices.com, 2 pages.

WebGen® 200, Material Not Dated, downloaded Dec. 15, 2022, www.orica.com/Products-Services/Blasting/Wireless/How-it-works/WebGen-200#, 11 pages.

Technical Information, Dinadrill® Booster 150G, Material Not Dated, downloaded Nov. 10, 2022, www.dinadrill.com/br.translate.goog/produtos/booster/150g?, 1 page.

Technical Information, Dinadrill® Booster 300G, Material Not Dated, downloaded Nov. 10, 2022, www.dinadrill.com/br.translate.goog/produtos/booster-300g?, 1 page.

Technical Information, Dinadrill® Booster 450G, Material Not Dated, downloaded Nov. 10, 2022, www.dinadrill.com/br.translate.goog/produtos/booster/450g?, 1 page.

Technical Data Sheet, DYNO® Nobel, Trojan® Stinger® Superprime® Cast Booster, Material Not Dated, downloaded Nov. 10, 2022, www.dynonobel.com, 2 pages.

Product Information Sheet, DYNO® Nobel, Trojan® Cast Boosters C-400, Material Not Dated, downloaded Nov. 21, 2022, www.sasol.com, 4 pages.

Technical Data Sheet, DYNO® Nobel, Trojan® Twinplex® Cast Booster, Material Not Dated, downloaded Nov. 14, 2022, www.dynobel.com, 2 pages.

Technical Data Sheet, DYNO® Nobel, Trojan® NB Universial, Superprime® Cord Sensitive Booster, Material Not Dated, downloaded Nov. 14, 2022, www.dynobel.com, 2 pages.

Product Information Sheet, Austin Powder Eagle® 450, Copyright 2020, downloaded Nov. 14, 2022, www.austinpowder.com, 2 pages.

Product Information Brochure, Austin Powder, DC Blast Boosters, Copyright 2020, downloaded Nov. 14, 2022, www.austinpowder.com, 2 pages.

Product Description, BME, Viper Booster®, Copyright 2021 Omnia Group, downloaded Nov. 21, 2022, www.dev.bme.co.za, 4 pages.

AEL Product Catalogue 2018, AECI Pentolite Primers, AEL Intelligent Blasting, downloaded Nov. 21, 2022, www.aelworld.com, pp. 120, 124-125, 3 pages.

Product Information Sheet, ENAEX, X-Booster®, FT 055/01/02 R0, dated Mar. 2021, 1 page, downloaded Dec. 15, 2022, www.enaex.com, 1 page.

Product Information Sheet, ENAEX, X-Booster® SS Booster, FT 055/02/02 R0, dated Mar. 2021, downloaded Dec. 15, 2022, www.enaex.com, 1 page.

Listing of Prior Art Photos by Manufacturer, provided by Applicants, 1 page.

* cited by examiner

EXPLOSIVE BOOSTER

FIELD OF THE INVENTION

THIS INVENTION relates to blasting, specifically in mining applications. More specifically, the invention relates to the initiation of bulk explosives. The invention provides an explosive booster for initiating a bulk explosive. The invention extends to a loaded explosive booster and to a blasting assembly including the loaded explosive booster. The invention also provides a method of blasting using the loaded explosive booster.

BACKGROUND TO THE INVENTION

BOOSTERS IN THE CONTEXT OF THE EXPLOSIVES INDUSTRY (i.e. "explosive boosters") are used to generate, through detonation of a sensitive detonable booster formulation, sufficient detonation pressure to initiate and thus cause detonation of a less sensitive bulk explosive.

Challenges have come to arise in using explosive boosters that rely on sensitive detonable booster formulations that are, themselves, classified as explosives. Such challenges include, for example, supply chain and transport challenges.

It would be advantageous to be able to exploit, for the initiation and detonation of bulk explosives, sensitive detonable booster formulations that are not, themselves, classified as explosives.

Such exploitation provides its own challenges, however, particularly in achieving a sufficient detonation pressure.

The present invention finds application in the exploitation of sensitive detonable booster formulations that are not, themselves, classified as explosives, in the initiation and detonation of less sensitive bulk explosives.

SUMMARY OF THE INVENTION

ACCORDING TO ONE ASPECT OF THE INVENTION THERE IS PROVIDED an explosive booster for initiating, and thus causing detonation of, a bulk explosive, the booster including

- a hollow body comprising a base member and a sidewall projecting from the base member, the body defining an interior space between the base member and the sidewall for containing a detonable booster formulation in use; and
- a hollow elongate initiator locating formation that projects longitudinally into the interior space at least from the base member and that defines an initiator channel that is open through the base member, for locating an explosive initiator (detonator) therein and thus in initiating proximity relative to a detonable booster formulation that is contained in the interior space in use, wherein the initiator channel extends longitudinally along a central longitudinal axis thereof that is radially spaced from a central longitudinal axis along which the interior space longitudinally extends.

The term "explosive initiator" referenced above, and hereinafter, includes within its meaning a detonator, e.g. a pyrotechnic detonator, and a blasting cap that serves to initiate the booster formulation inside the booster. Such an explosive initiator is typically in the form of an elongate container, of lesser diameter than that of the interior space of the booster, e.g. about 10 mm or less, that contains a primary explosive charge.

Typically, and in fact preferably, the central longitudinal axis of the initiator channel would be parallel to the central longitudinal axis of the interior space.

Preferably, the initiator locating formation projects into the interior space from beyond the base member, i.e. from outside of the interior space.

More particularly, the locating formation may extend along, and is thus connected to, the sidewall along at least a part of length of the locating formation, thus defining the initiator channel at the described location.

It will be understood that the initiator locating formation therefore interfaces with the sidewall, and that a part of the initiator locating formation therefore comprises, or is comprised by, the sidewall.

Furthermore, in projecting longitudinally into the interior space along the sidewall, the initiator locating formation is thus located such that the initiator channel extends longitudinally along the central longitudinal axis thereof.

The central longitudinal axis of the initiator channel is further in parallel with, while also being radially spaced with respect to, the central longitudinal axis of the interior space, along which the interior space longitudinally extends.

The interior space and the initiator channel may have each have a geometrically shaped cross-sectional outline, both preferably being circular.

The cross-sectional outlines of the interior space and the initiator channel may be substantially constant along their respective lengths.

The interior space may have a diameter of at least about 40 mm, more preferably at least about 50 mm, most preferably at least about 60 mm, e.g. 59.47 mm, even up to about 120 mm or more.

The interior space may extend along a length of from about 93 mm, e.g. extends along a length of about 93 mm.

The base member may have a thickness of from about 1.5 mm, e.g. having a thickness of about 1.5 mm.

The initiator locating channel may have a length sufficient to locate therein, and more specifically in a part thereof that is located inside the interior space, an elongate initiator that has a length of from about 55 mm to about 100 mm. The initiator locating channel may therefore, for example, have a length of about 113.50 mm.

Walls of the initiator locating formation that are located inside the interior space, that do not interface with the sidewall, may have a thickness of from about 0.6 to about 0.99 mm, e.g. about 0.8 mm.

The initiator locating formation may terminate at a distal end thereof that comprises a distal end wall that is located inside the interior space, which distal end wall be spaced from, i.e. located short of, a distal end of the interior space. More specifically, the end wall may be spaced a spacing of at least 20 mm, more preferably more than 20 mm, e.g. up to 30 mm, or more from the distal end of the interior space.

The distal end wall may have a thickness greater than that of the walls of the initiator locating formation that are located inside the interior space and that do not interface with the sidewall, for example being about 1 mm thick.

The body may further include a lacing formation defining an elongate lacing channel extending longitudinally along a lacing axis, through and along which to lace shock signal propagating means, e.g. shock tube, in use. In other words, shock signal propagating means may in use be laced through the lacing channel and thus along the lacing axis, thereby being connected to the booster. Such shock tube would in use typically terminate in an initiator, which would in use be located in the locating channel.

The lacing formation may be located such that the lacing channel extends longitudinally along a side of the body, outside of the interior space, and such that the lacing axis is parallel to both the central longitudinal axis of the interior space and the central longitudinal axis of the initiator channel.

Furthermore, the lacing formation may be provided such that the lacing axis is angularly spaced from the central longitudinal axis of the initiator channel about the central longitudinal axis of the interior space and is also radially spaced from the central longitudinal axis of the initiator channel along radii of the central longitudinal axis of the interior space, i.e. such that the lacing axis is radially further away from the central longitudinal axis of the interior space than the central longitudinal axis of the initiator channel.

The lacing channel may be of substantially constant cross-sectional outline along its length, which cross-sectional outline is preferably circular.

The lacing formation may extend along, and thus be connected to, the sidewall along at least a part of the length of the lacing formation. The lacing formation may therefore interface with the sidewall, and a part of the lacing formation may therefore comprise, or may be comprised by, the sidewall.

Other than at interfaces with the initiator locating formation and lacing formation respectively, the sidewall of the body may have a thickness of from about 2 mm to about 3.5 mm, e.g. about 2.28 mm.

The body may define a mouth at which the interior space terminates and through which a detonable booster formulation may be loaded into the interior space in use. The mouth may provide the distal end of the interior space. In one embodiment of the invention, the mouth may be defined by an end of the sidewall that is distally located with respect to the base member.

The mouth may be closable by a removable closure member, i.e. a lid or cap. The booster may therefore include a closure member for closing the mouth.

The closure member may be mountable to the body to close the mouth. In other words, the closure member may be configured such that the closure member is mountable to the body to close the mouth To this effect, the closure member and the body may have complementary thread formations that may be threaded to screw the closure member onto the body, thus mounting the closure member on the body and closing the mouth.

The complementary thread formations may be configured for effecting secure, i.e. tight, more specifically liquid tight, mounting of the closure member to the body, in a secured condition, by threading engagement of the complementary thread formations through e.g. two revolutions of the closure member about a screw axis. The screw axis may co-extend with the central longitudinal axis of the interior space.

The closure member may be configured to close the mouth liquid-tightly, and thus render the interior space liquid-tightly closed.

For example, the closure member may, in addition to being threaded for threading engagement with the complementary thread on the body, comprise a channel formation within which to seat a part of the body that defines the mouth.

The closure member and the body may be of different materials. Alternatively, and more typically, the closure member and the body may be of the same material.

The mounting member may be provided by the closure member, typically being located atop the closure member.

The mounting member may be configured to grip detonation signal propagating means, e.g. shock tube, and thus locate the booster relative to such detonation signal propagating means. For example, the mounting member may grip the detonation signal propagating means in use such that the booster hangs suspended from such detonation signal propagating means, preferably such that the central longitudinal axis of the interior space extends substantially vertically.

Typically, detonation signal propagating means would in use be located in such proximity to a bulk explosive that such location of the booster relative to such detonation signal propagating means would locate the booster relative to such bulk explosive in sufficiently close proximity for the booster to initiate the bulk explosive.

The mounting member may define a gripping axis, along which detonating signal propagating means gripped by the mounting member in use, may extend.

When located atop the closure member, the location of the mounting member atop the closure member may be such that, when the closure member has been screwed onto the body to close the mouth liquid-tightly, e.g. when the closure member is in the secured condition, the mounting member is radially spaced from the screw axis such that the gripping axis intersects the screw axis and the lacing axis respectively, thus extending substantially perpendicular to those axes.

Thus, in use, detonation signal propagating means, e.g. shock tube, may, with the closure member in the secured condition, be gripped by the mounting member along the gripping axis and be laced through the lacing channel along the lacing axis, bending substantially 90° in doing so.

Such detonation signal propagating means would in use terminate in an initiator, which would in use be located inside the initiator channel.

Thus, in use, a detonation initiating signal propagated along such detonation signal propagating means would reach and initiate such an initiator, causing it to detonate a detonable booster formulation contained in the interior space of the body in use which would, in turn, cause detonation of a bulk explosive in detonating proximity to the booster in use.

The booster may further comprise, on the closure member, a shielding formation located to shield detonation signal propagating means gripped by the gripping means, in order to prevent the detonation signal propagating means from being damaged. The shielding formation may extend parallel to the gripping axis. In one embodiment of the invention, the shielding formation may be a protrusion, e.g. an oblong protrusion, projecting from atop the closure to a distance further than the thickness of detonation signal propagating means to be used with the booster. Advantageously, such a shielding formation may also strengthen the structural integrity of the closure member.

The body may be of a thermally stable engineering polymer, i.e. a polymer that has a melting point greater than 200 to 250° C.

THE INVENTION EXTENDS TO a loaded explosive booster comprising

- an explosive booster according to the invention,
- a detonable booster formulation in the interior space of the body of the explosive booster,
- the body of the explosive booster being closed with the closure member in the secured condition.

The interior space of the body may be partially filled with the detonable booster formulation. In other words, there may be air inside the interior space of the body in addition to detonable booster formulation, and the interior space of the body may therefore not be filled entirely (i.e. to the brim) with the detonable booster formulation.

The detonable booster formulation may be a non-explosive detonable booster formulation, i.e. a non-explosive substance, in the sense that while producing an explosive effect, the detonable booster formulation may itself be of such a composition that it is not classified as an explosive.

More specifically, the detonable booster formulation may be a perchlorate-based, particularly a sodium perchlorate-based, formulation, typically being mixed with other non-explosive components.

THE INVENTION ALSO EXTENDS TO a blasting assembly comprising

- a loaded explosive booster according to the invention;
- detonation signal propagating means gripped by the mounting member and laced through the lacing channel of the explosive booster such that the detonation signal propagating means extends along the gripping and lacing axes; and
- an explosive initiator located in the initiator channel, to which initiator the detonation signal propagating means is operatively connected.

ACCORDING TO ANOTHER ASPECT OF THE INVENTION IS PROVIDED a method of blasting, specifically of blasting earth or rock, the method including

- locating a blasting assembly according to the invention, in initiating proximity to a bulk explosive in a body of earth or rock to be blasted; and
- causing the initiator of the loaded explosive booster to detonate the detonable booster formulation and, thus, the bulk explosive, by communicating a detonation signal to the initiator along the detonation signal propagating means.

The bulk explosive may be a charge of emulsion explosive, such as ammonium nitrate/fuel oil (ANFO).

Locating the blasting assembly in a body of earth or rock to be blasted may include forming a borehole in the body or earth or rock.

DETAILED DESCRIPTION OF ONE EMBODIMENT OF THE INVENTION

THE INVENTION WILL NOW BE DESCRIBED IN MORE DETAIL by way of non-limiting example with reference to an embodiment thereof as illustrated in the accompanying drawings.

Figure 1:
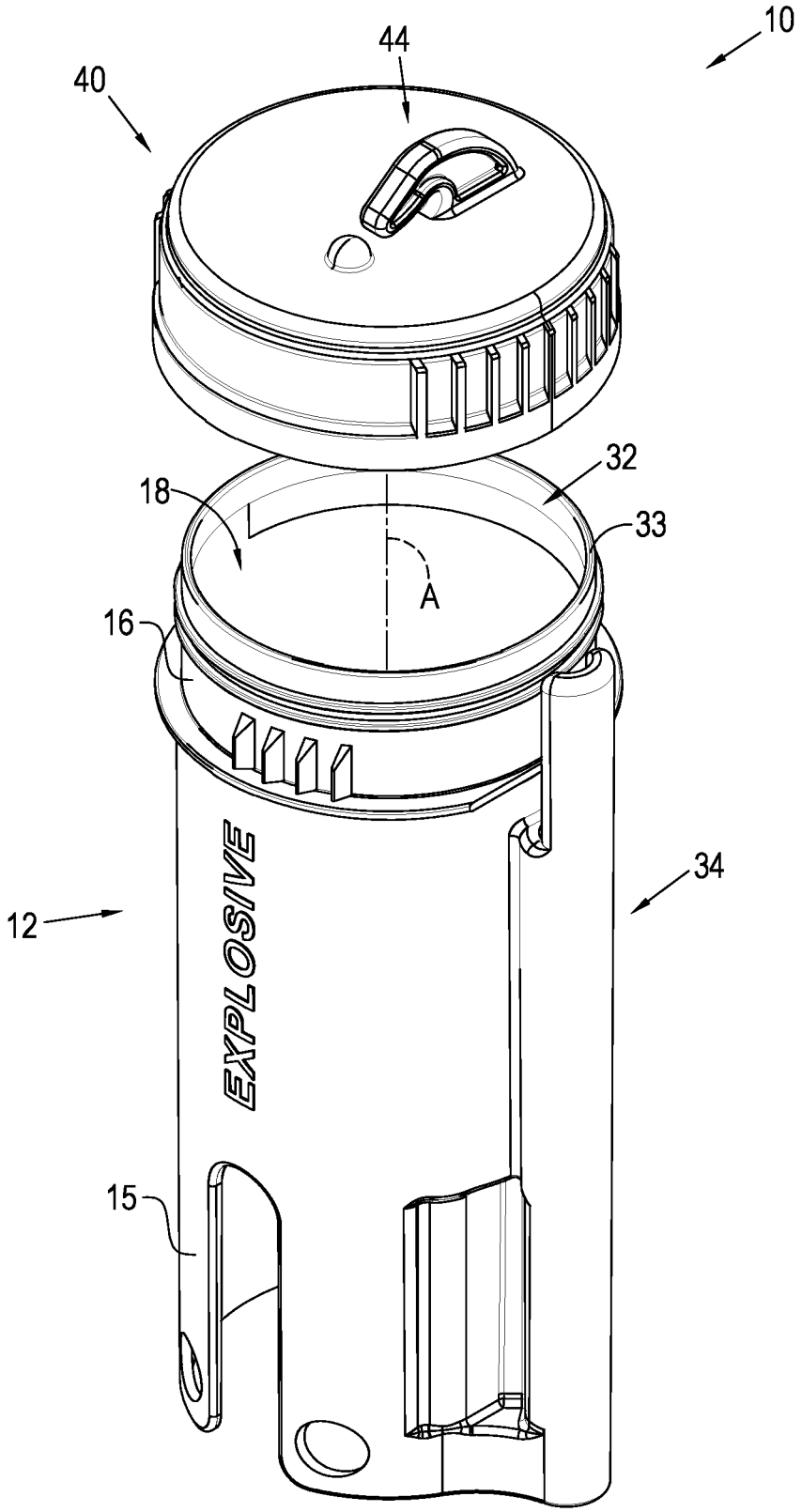
FIG. 1 shows a booster according to the invention in three-dimensional open view.
Figure 2:
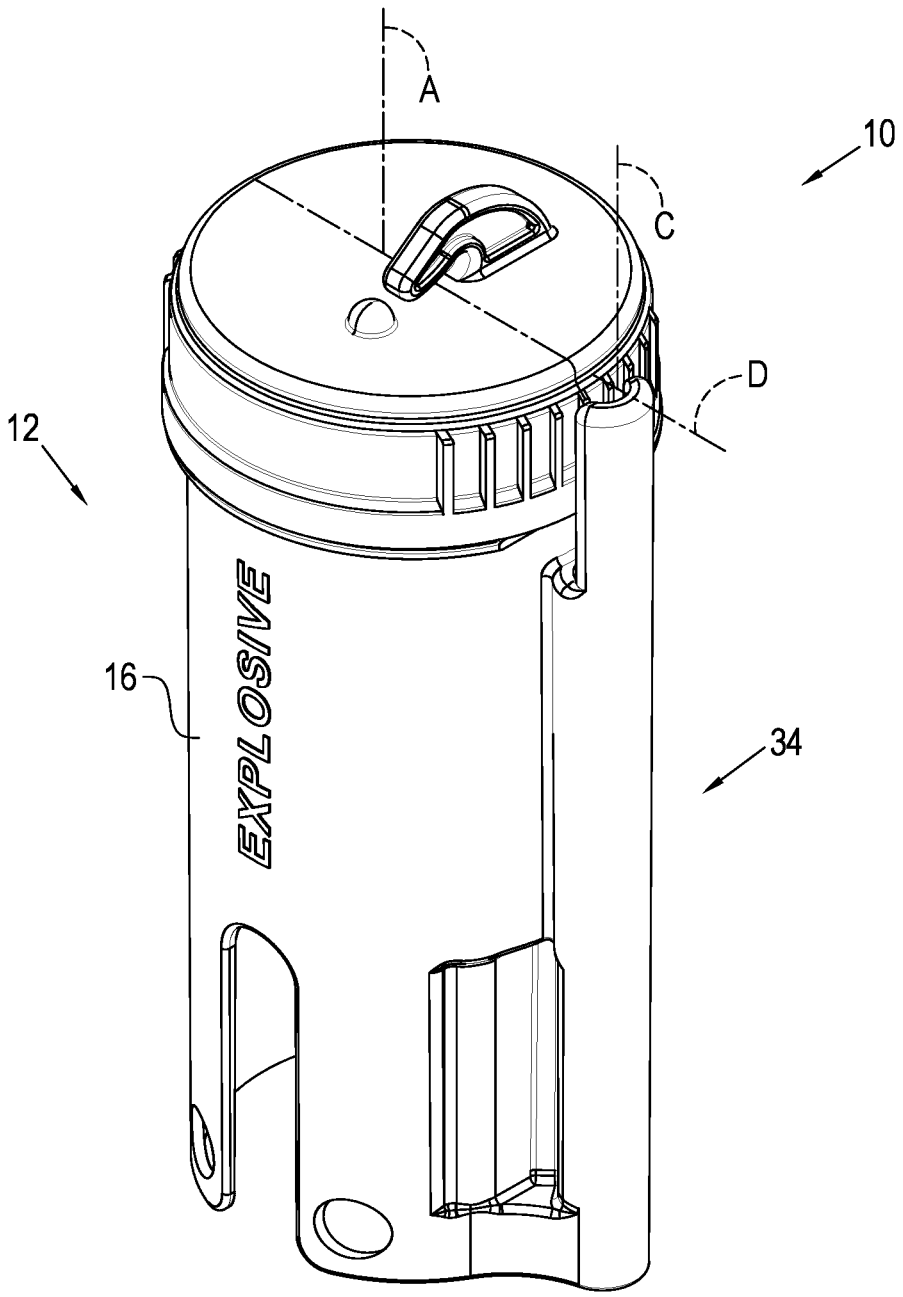
FIG. 2 shows the explosive booster of FIG. 1 assembled in one three-dimensional closed view.
Figure 3:
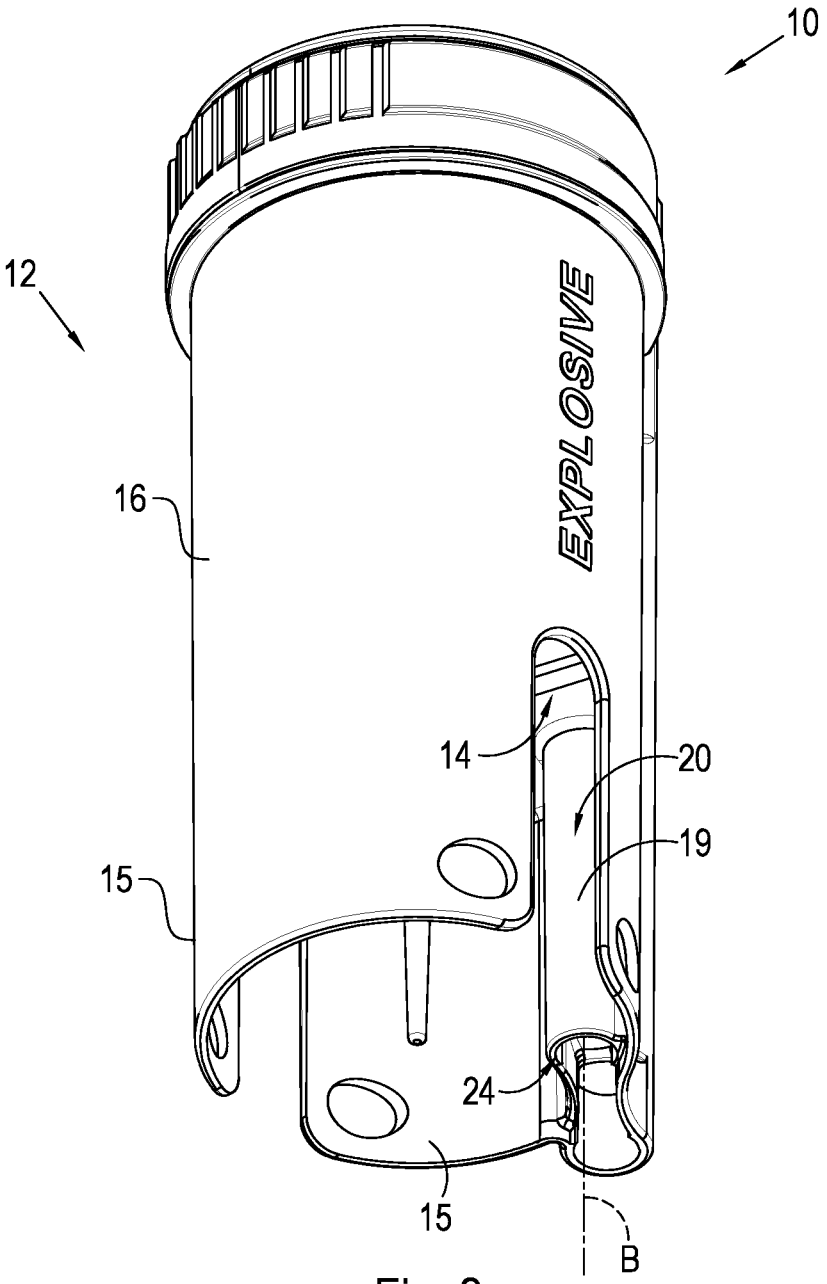
FIG. 3 shows the explosive booster of FIG. 2 in another three-dimensional closed view.

Referring to the drawings, reference numeral 10 generally indicates an explosive booster according to the invention.

The booster 10 includes a hollow body 12. The body 12 is of a rigid polymeric material, preferably a thermally stable engineering polymer, i.e. a polymer that has a melting point greater than 200 to 250° C. e.g. one or more of HDPE, PTFE, PP, PET, LDPE.

The body 12 comprises a base member 14 and a sidewall 16 that projects from the base member 14 and a skirt member 15 that depends from the base member 14. The base member 14 is of circular plan view outline and the sidewall 16 is of circular cross-sectional outline.

The body 12 defines an interior space 18 between the base member 14 and the sidewall 16, for containing a detonable booster formulation as described in accordance with the invention, in use.

The interior space 18 extends longitudinally along a central longitudinal axis A thereof.

The booster 10 further includes a hollow elongate initiator locating formation 20 that projects longitudinally into the interior space 18 through the base member 14.

The locating formation 20 defines an initiator channel 22 that extends along a central longitudinal axis B thereof.

The central longitudinal axes A, B of the interior space 18 and initiator channel 22 are parallel, with the axis B being radially spaced with respect to the axis A.

The initiator channel 22 is open through the base member 14, defining an open mouth 24 of the channel 22 at an end of the locating formation 20 that is outside of the interior space 18.

At an opposite, distal, end inside the interior space 18, the locating formation 20 has an end wall 26 that closes the initiator channel 22.

The initiator channel 22 is also of circular cross section.

The locating formation 20 extends along, and is thus connected to and interfaces with, the sidewall 16 along the length of the locating formation 20 at an interface 17 therewith. The locating formation 20 thus partly comprises, or is partly comprised by, the sidewall 16. Other longitudinally extending walls 19 of the locating formation do not interface with the sidewall 16.

In use, the locating formation 20 serves to locate an explosive initiator (detonator) in the initiator channel 22, and thus in initiating proximity relative to a detonable booster formulation that is contained in the interior space 18 in use.

The interior space 18 has a diameter D1 of about 60 mm, e.g. 59.47 mm, and a length L1 of 93 mm.

The locating channel 22 has a length L2 of 113.50 mm and a diameter D2 of 8.78 mm.

Walls 19 of the locating formation 20 that do not interface with the sidewall 16, i.e. that do not comprise or are not comprised by the sidewall 16, have a thickness T1 of 0.8 mm.

The end wall 26 of the locating formation located inside the interior space 18 is spaced from, i.e. is located short of, a mouth 32 of the interior space 18, the mouth 32 being defined by an end 33 of the sidewall 16 that is distally located with respect to the base member 14.

Thus, space is defined inside the interior space 18 of the body 12, between the distal end 26 of the locating formation 20 and the end 33 of the sidewall 16, with such space extending longitudinally for a length L3 of just over 30 mm, e.g. 32.07 mm.

Figure 9:
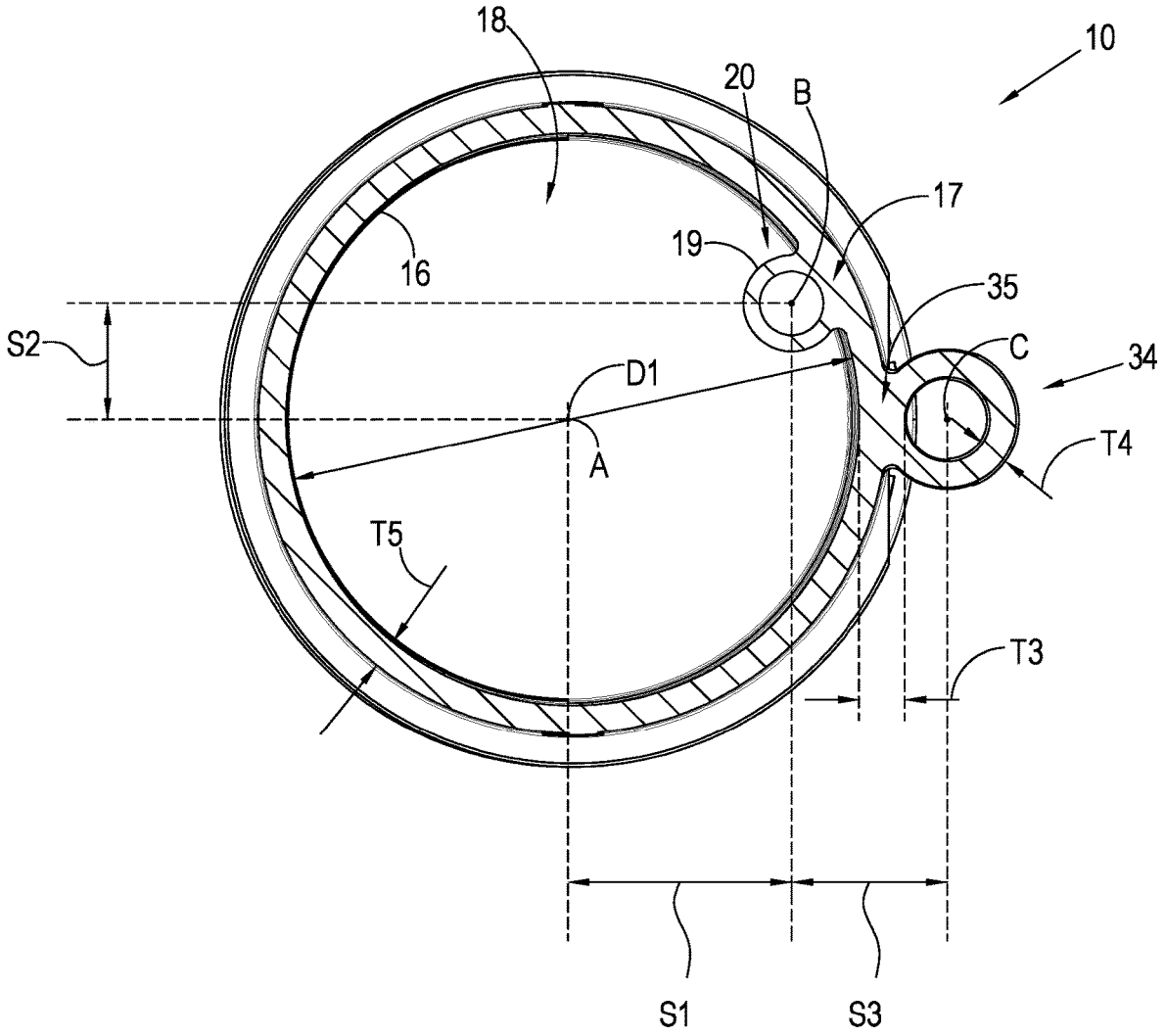
FIG. 9 shows the explosive booster of FIG. 2 in cross section along Z-Z.

As illustrated more clearly in FIG. 9, it will be understood that, in extending longitudinally into the interior space 18 of the body 12 along the sidewall 16, the locating formation 20 is located such that the central longitudinal axis B of the initiator channel 22 is radially spaced from the central longitudinal axis A of the interior space 18. The extent of this spacing is such that the initiator channel 22 is essentially being located at the furthest possible outer extremity of the interior space 18, considering that it also interfaces with the sidewall 16.

More specifically, the locating formation 20 is located such that the central longitudinal axis B of the initiator channel 22 is spaced at lateral spacings S1 of 22.05 mm and S2 of 13.82 mm from the central longitudinal axis A of the interior space 18.

The body 12 further includes a lacing formation 34 defining an elongate lacing channel 36 that extends along a lacing axis C, through and along which to lace shock signal propagating means, e.g. shock tube, in use.

The lacing formation 34 is provided such that the lacing channel 36 extends longitudinally along a side of the body 12, outside of the interior space 18, and such that the lacing axis C is parallel to the central longitudinal axis A of the interior space 18 and the central longitudinal axis B of the initiator channel 22.

Furthermore, the lacing formation 34 is provided such that the lacing axis C is angularly spaced from the central longitudinal axis B of the initiator channel 22 about the central longitudinal axis A of the interior space 18. More specifically, the lacing formation 34 and the locating formation 20 are located such that the central longitudinal axis B of the initiator channel is spaced at lateral spacings S3 of 17.72 mm and S2 of 13.82 mm from the lacing axis C.

The lacing formation 34 extends along, and is thus connected to, the sidewall 16 along the length of the lacing formation 34. The lacing formation 34 therefore interfaces with the sidewall 16 at an interface 35 where the lacing formation 34 comprises, or is comprised by, the sidewall 16.

The interface 35 has a thickness T3 of at most 5 mm.

Walls 38 of the lacing formation 34 that do not interface with the sidewall 16 have a thickness T4 of from about 2 mm to about 3.5 mm.

Other than at interfaces 17, 35 with locating formation 20 and the lacing formation 34 respectively, the sidewall 16 has a thickness T5 of 2.28 mm.

The base member has a thickness T6 of 1.5 mm.

The end wall 26 has a thickness T7 of 1 mm.

In use, a detonable booster formulation may be loaded into the interior space 18 through the mouth 32.

The mouth 32 is closable by a removable closure member 40.

The closure member 40 is mountable to the body 12 to close the mouth 32. More specifically, the closure member 40 and the body 12 have complementary thread formations that are threaded to screw the closure member 40 onto the body 12 to close the mouth 32.

The complementary thread formations are configured to effect secure, i.e. tight, mounting of the closure member 40 to the body 12, in a secured condition, by threading engagement of the complementary thread formations through two revolutions of the closure member 40 about a screw axis co-extending with the central longitudinal axis A of the interior space 18.

The closure member 40 is configured to close the mouth 32 liquid-tightly. Thus, the closure member 40, in addition to being threaded for threading engagement with the complementary thread on the body 12, provides a channel formation 42 within which to seat the part of the body 12 that defines the mouth 32 when the closure member 40 is mounted to the body 12 such that it closes the mouth 40.

The closure member 40 is preferably of the same material as the material of the body 12.

The booster 10 further includes a mounting member in the form of a resilient gripping hook 44 provided atop the closure member 40, for locating the booster 10 relative to a bulk explosive in use, to initiate such a bulk explosive.

The gripping hook 44 serves in use to grip detonation signal propagating means, e.g. shock tube, and thus locate the booster 10 relative to such detonation signal propagating means, e.g. such that the booster hangs substantially vertically suspended from such detonation signal propagating means.

In use, detonation signal propagating means from which the booster 10 would be suspended, would in use be located in such proximity to a bulk explosive that such location of the booster 10 relative to such detonation signal propagating means would locate the booster 10 relative to such a bulk explosive in sufficiently close proximity for the booster 10 to initiate the bulk explosive.

The gripping hook 44 defines a gripping axis D along which detonating signal propagating means gripped by the gripping hook 44 would in use extend.

Figure 4:
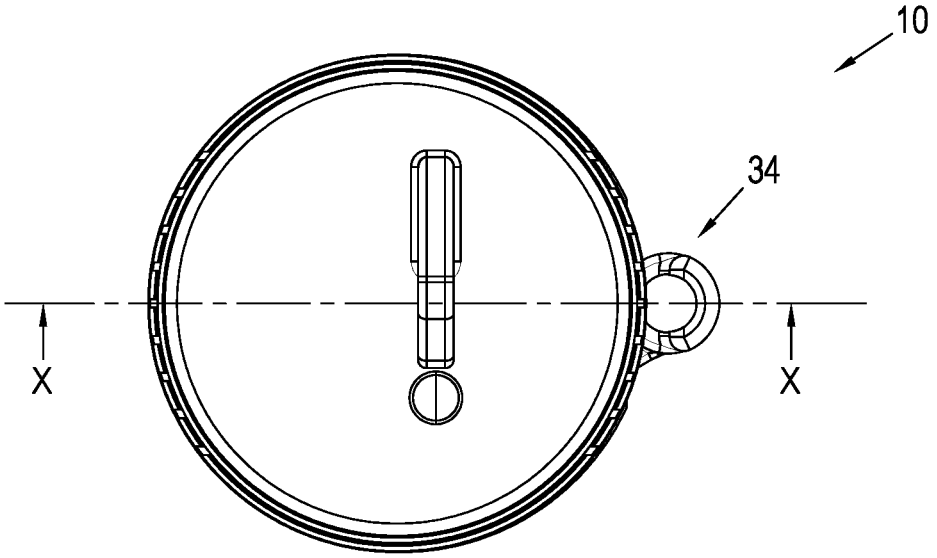
FIG. 4 shows the explosive booster of FIG. 2 in top view.
Figure 5:
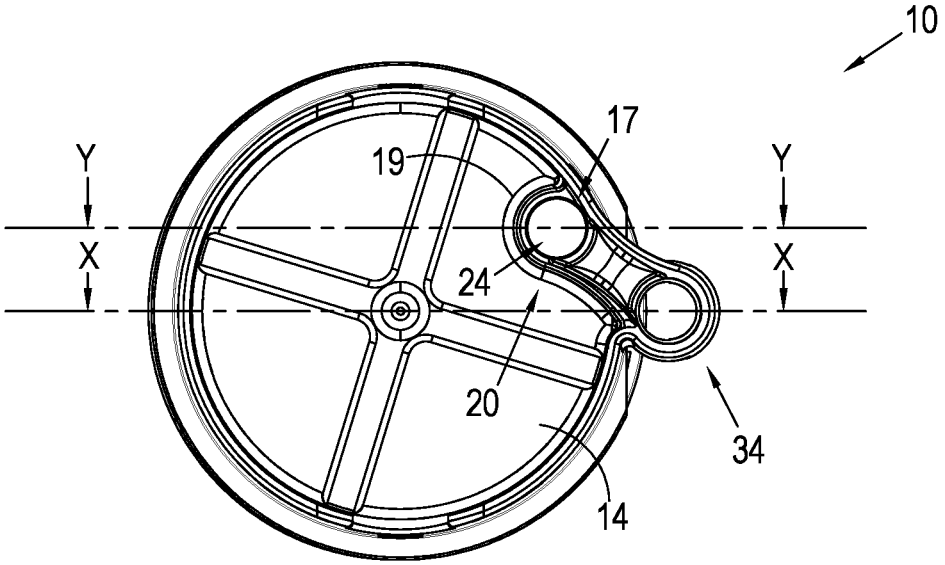
FIG. 5 shows the explosive booster of FIG. 2 in bottom view.
Figure 6:
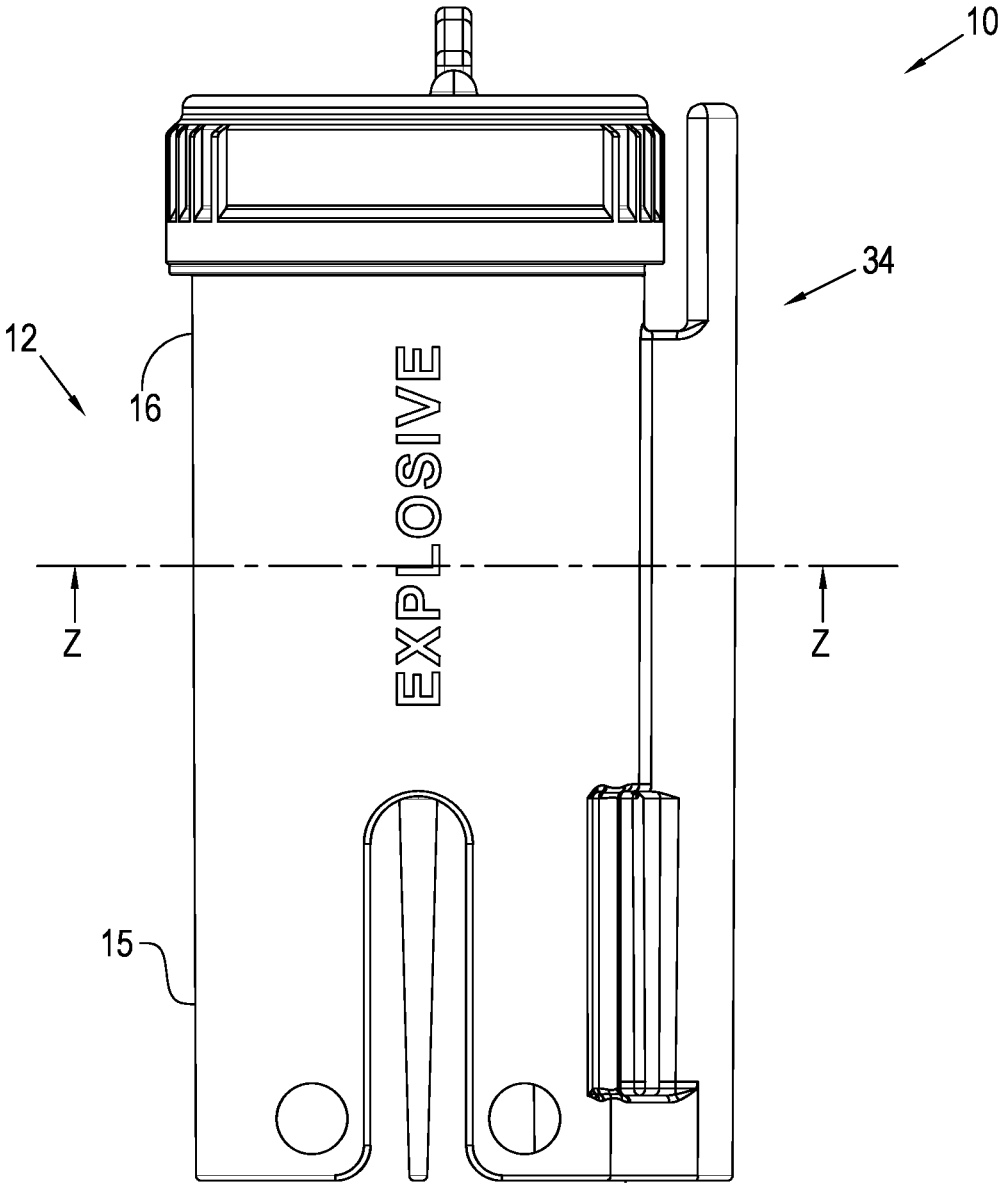
FIG. 6 shows the explosive booster of FIG. 2 in one side view.
Figure 7:
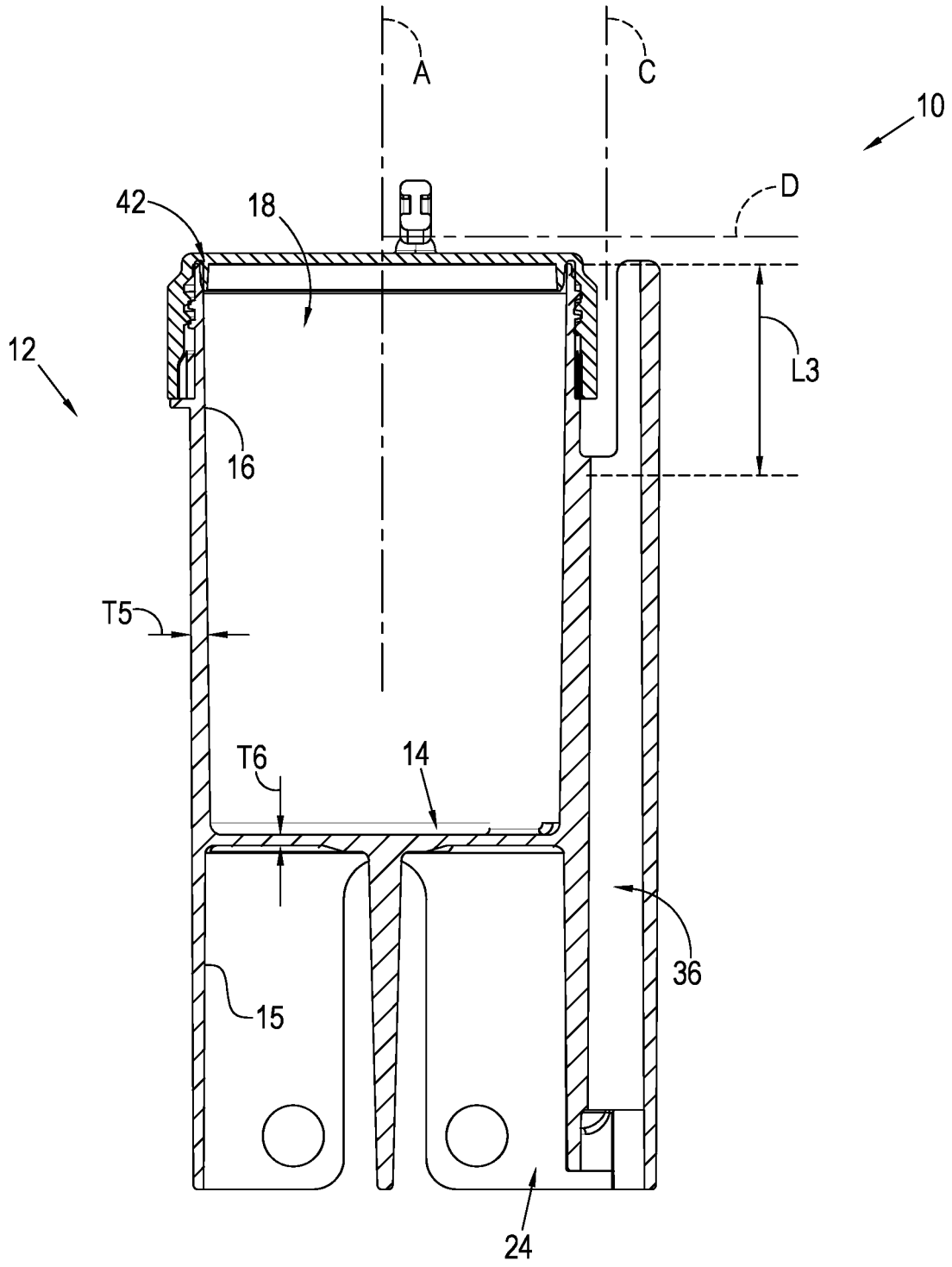
FIG. 7 shows the explosive booster of FIG. 2 in longitudinal section along X-X.
Figure 8:
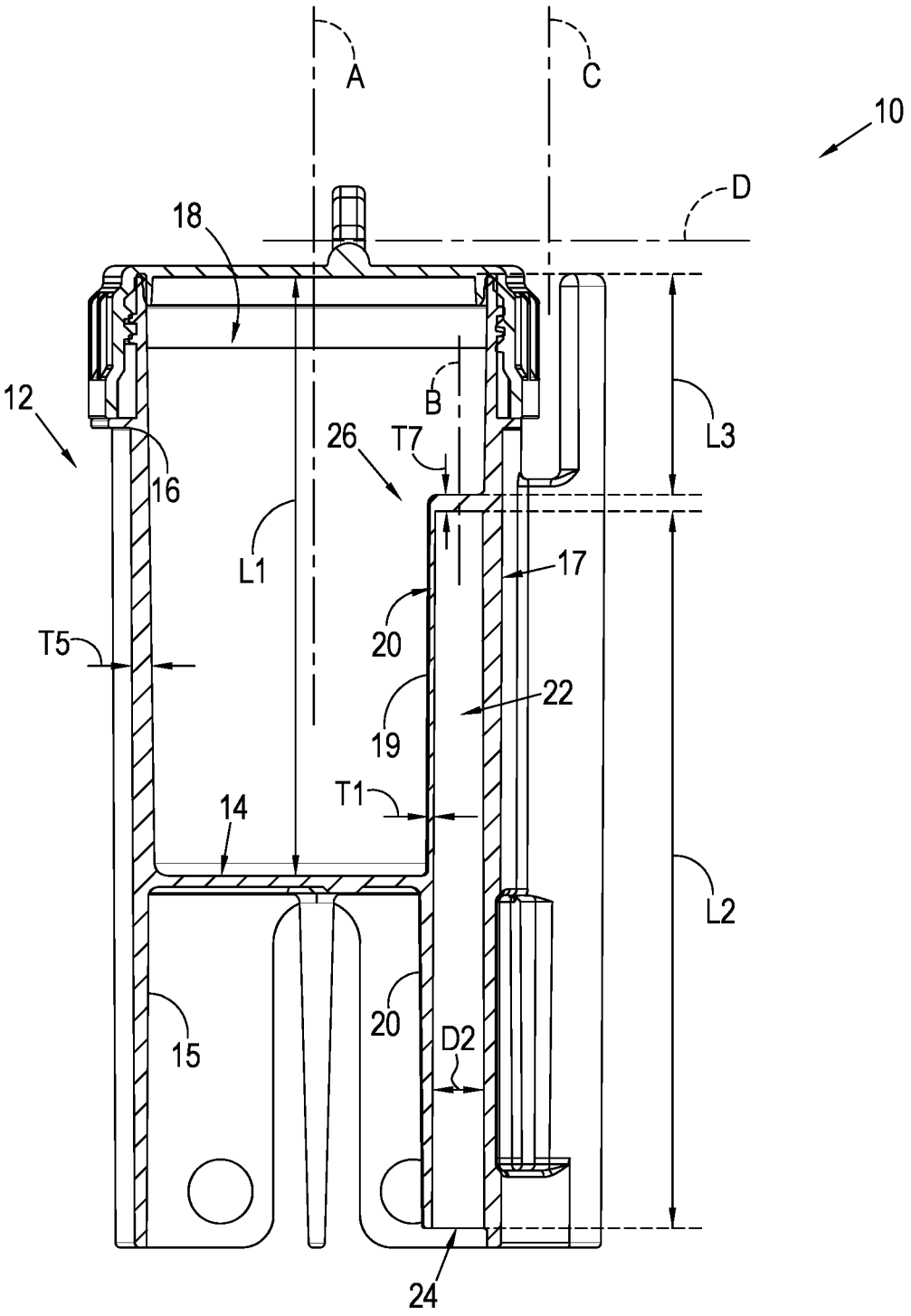
FIG. 8 shows the explosive booster of FIG. 2 in longitudinal section along Y-Y.

The location of the gripping hook 44 atop the closure member 40 is such that, when the closure member 40 is in the secured condition, as illustrated in FIG. 4) the gripping hook is spaced from the screw axis such that the gripping axis D crosses the screw axis (and therefore the central longitudinal axis A) and the lacing axis C, extending substantially perpendicularly to the screw axis and lacing axis C.

Thus, in use, detonation signal propagating means, e.g. shock tube, with the closure member 40 in the secured condition, is gripped by the gripping hook 44 along the gripping axis D and be laced through the lacing channel along the lacing axis C.

Such detonation signal propagating means would in use terminate in an initiator, which would in use be located inside the initiator channel, to initiate a detonable booster formulation in use loaded in the interior space 18 of the body 12.

Thus, in use, a detonation initiating signal propagated along such detonation signal propagating means would reach and initiate such an initiator, causing it to detonate a detonable booster formulation contained in the interior 18 of the body 12 in use which would, in turn, cause detonation of a bulk explosive in detonating proximity to the booster 10 in use.

DISCUSSION

THE APPLICANT has surprisingly found that a booster of the configuration as described according to the invention produces sufficient detonation pressures, using non-explosive detonable booster formulations, to exploit such formulations effectively in the detonation of bulk explosives.

An associated advantage of having enabled such exploitation is that the booster of the invention, filled with a non-explosive detonable booster formulation, would avoid challenges associated with boosters that exploit explosive detonable booster formulations as alluded to in the background section herein.

The invention claimed is:

1. An explosive booster for initiating, and thus causing detonation of, a bulk explosive, the booster including a hollow body comprising a base member and a sidewall projecting from the base member, the body defining an interior space between the base member and the sidewall for containing a detonable booster formulation in use;

a hollow elongate initiator locating formation that projects longitudinally into the interior space at least from the base member and that defines an initiator channel that is open through the base member, for locating an explosive initiator therein and thus in initiating proximity relative to a detonable booster formulation that is contained in the interior space in use, wherein the initiator channel extends longitudinally along a central longitudinal axis thereof that is radially spaced from and parallel to a central longitudinal axis along which the interior space longitudinally extends, wherein the body defines a mouth at which the interior space terminates and through which a detonable booster formulation may be loaded into the interior space in use, the mouth thus providing a distal end of the interior space, the booster further including a removable closure member that is of a material different to the material of the body and is configured such that the closure member is mountable to the body to close the mouth, and wherein the closure member and the body have complementary thread formations that are threadable to screw the closure member onto the body, thus mounting the closure member on the body and closing the mouth, the complementary thread formations being configured for effecting liquid tight mounting of the closure member to the body by threading engagement of the complementary thread formations through two revolutions of the closure member about a screw axis that co-extends with the central longitudinal axis of the interior space; and the closure member comprises a channel formation within which a part of the body that defines the mouth is seated when the closure member is screwed onto the body.

2. The explosive booster according to claim 1, wherein the initiator locating formation extends along, and is thus connected to, the sidewall along at least a part of length of the locating formation, such that the initiator locating formation interfaces with the sidewall and such that that a part of the initiator locating formation therefore comprises, or is comprised by, the sidewall.

3. The explosive booster according to claim 1, wherein the interior space and the initiator channel have each have a circular cross-sectional outline that is substantially constant along their respective lengths.

4. The explosive booster according to claim 1, wherein the interior space has a diameter of at least about 40 mm, more preferably at least about 50 mm, most preferably at least about 60 mm;

the interior space extends along a length of from about 93 mm;

the base member has a thickness of from about 1.5 mm;

the initiator locating channel has a length sufficient to locate therein, and more specifically in a part thereof that is located inside the interior space, an elongate initiator that has a length of from about 55 mm to about 100 mm;

walls of the initiator locating formation that are located inside the interior space and that do not interface with the sidewall have a thickness of from about 0.6 to about 0.99 mm.

5. The explosive booster according to claim 4, wherein the initiator locating channel has a length of about 113.50 mm.

6. The explosive booster according to claim 1, wherein the initiator locating formation terminates at a distal end thereof that comprises a distal end wall that is located inside the interior space, which distal end wall is spaced from a distal end of the interior space at a spacing of at least 20 mm.

7. The explosive booster according to claim 1, wherein the distal end wall has a thickness greater than that of the walls of the initiator locating formation that are located inside the interior space and that do not interface with the sidewall.

8. The explosive booster according to claim 1, which includes a lacing formation defining an elongate lacing channel extending along a side of the body, outside of the interior space, longitudinally along a lacing axis that is parallel to both the central longitudinal axis of the interior space and the central longitudinal axis of the initiator channel, through and along which to lace shock signal propagating means in use and thus connect such shock signal propagating means to the booster in use.

9. The explosive booster according to claim 8, wherein, other than at interfaces with the initiator locating formation and lacing formation respectively, the sidewall of the body has a thickness of from about 2 mm to about 3.5 mm.

10. The explosive booster according to claim 1, which includes a mounting member atop the closure member, wherein the mounting member defines a gripping axis and is configured to grip detonation signal propagating means such that the detonation signal propagating means extends along the gripping axis.

11. The explosive booster according to claim 10, wherein the lacing formation is located such that the lacing axis is angularly spaced from the central longitudinal axis of the initiator channel about the central longitudinal axis of the interior space and also radially spaced from the central longitudinal axis of the initiator channel along radii of the central longitudinal axis of the interior space;

extends along, and is thus connected to, the sidewall along at least a part of the length of the lacing formation, such that the lacing formation interfaces with the sidewall with and a part of the lacing formation therefore comprising, or being comprised by, the sidewall.

12. The explosive booster according to claim 10, wherein the location of the mounting member atop the closure member is such that, when the closure member has been screwed onto the body to close the mouth liquid-tightly, the mounting member is radially spaced from the screw axis such that the gripping axis perpendicularly intersects the screw axis and the lacing axis respectively.

13. A loaded explosive booster comprising an explosive booster according to claim 1, and a detonable booster formulation in the interior space of the body of the explosive booster, wherein the body of the explosive booster is closed liquid-tightly with the closure member.

14. The loaded explosive booster according to claim 13, wherein the interior space of the body is partially filled with the detonable booster formulation, such that there is air inside the interior space of the body in addition to detonable booster formulation.

15. The loaded explosive booster according to claim 13, wherein the detonable booster formulation is a sodium perchlorate-based, formulation.

16. A blasting assembly comprising a loaded explosive booster according to claim 13 which includes a mounting member atop the closure member, wherein the mounting member defines a gripping axis and is configured to grip detonation signal propagating means such that the detonation signal propagating means extends along the gripping axis, wherein the location of the mounting member atop the closure member is such that, when the closure member has been screwed onto the body to close the mouth liquid-tightly, the mounting member is radially spaced from the screw axis such that the gripping axis perpendicularly intersects the screw axis and the lacing axis respectively;

detonation signal propagating means gripped by the mounting member and laced through the lacing channel of the explosive booster such that the detonation signal propagating means extends along the gripping and lacing axes; and an explosive initiator located in the initiator channel, to which initiator the detonation signal propagating means is operatively connected.

17. A method of blasting earth or rock, the method including locating a blasting assembly according to claim 16 in initiating proximity to a bulk explosive in a body of earth or rock to be blasted; and causing the initiator of the loaded explosive booster to detonate the detonable booster formulation and, thus, the bulk explosive, by communicating a detonation signal to the initiator along the detonation signal propagating means.

* * * * *